US007008241B2

(12) United States Patent
Marceau et al.

(10) Patent No.: US 7,008,241 B2
(45) Date of Patent: Mar. 7, 2006

(54) ELECTRICAL CONNECTOR ASSEMBLY

(75) Inventors: Scott P. Marceau, Plainfield, IL (US); Paul C. Berg, Batavia, IL (US); Mark A. Cole, Matteson, IL (US); Jonathan D. Lohman, West Chicago, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/848,264

(22) Filed: May 18, 2004

(65) Prior Publication Data

US 2004/0214459 A1 Oct. 28, 2004

Related U.S. Application Data

(63) Continuation of application No. 10/262,986, filed on Oct. 2, 2002, now abandoned.

(51) Int. Cl.
*H01R 12/00* (2006.01)

(52) U.S. Cl. ..... 439/83

(58) Field of Classification Search ..... 439/83, 439/74, 76.1, 692, 874, 82
See application file for complete search history.

(56) References Cited

U.S. PATENT DOCUMENTS 5,451,174 A * 9/1995 Bogursky et al. ..... 439/876
6,336,829 B1 * 1/2002 Matsukawa ..... 439/660

* cited by examiner

*Primary Examiner*—Phuong Dinh
(74) *Attorney, Agent, or Firm*—Romi N. Bose

(57) ABSTRACT

An electrical connector termination assembly includes a dielectric pin holder. A plurality of elongated terminal pins extend through the pin holder in a pattern of at least two rows of pins with the pins in the respective rows being aligned transversely of the rows. Each of at least some of the terminal pins defining a longitudinal axis and including an arm at a termination end of the pin offset from the longitudinal axis. The arm is bent to define a termination pad extending transversely of the longitudinal axis.

19 Claims, 4 Drawing Sheets

FIG.5
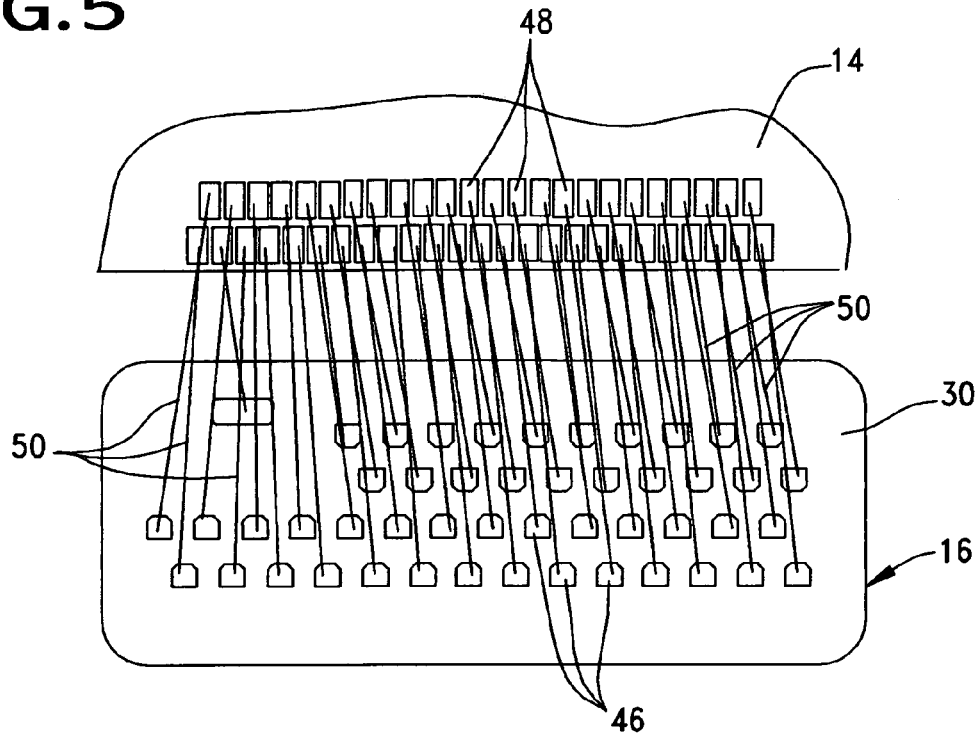
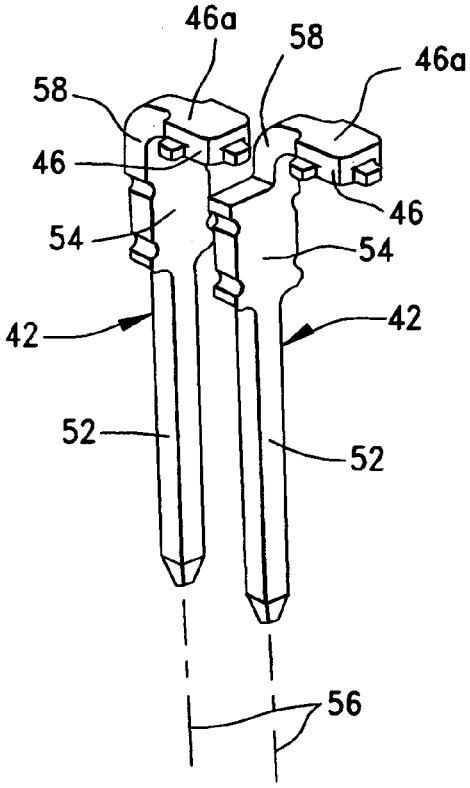
FIG.6
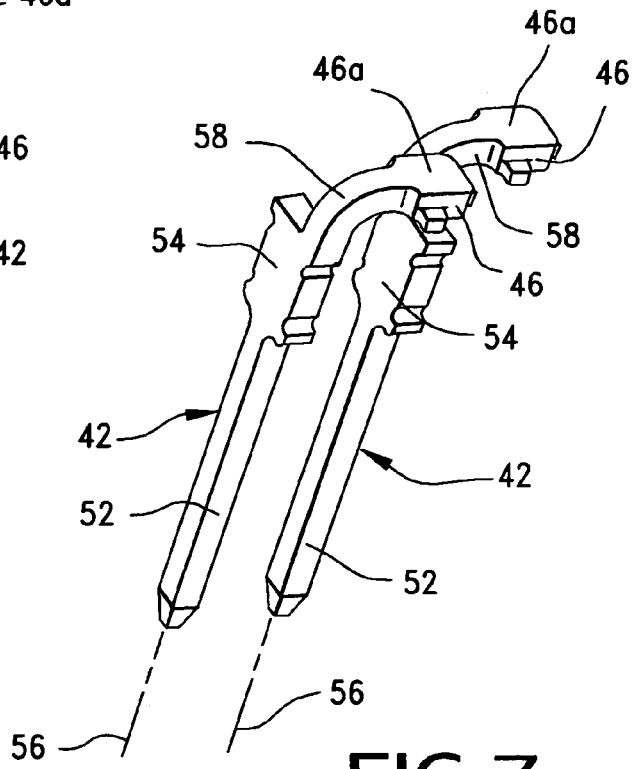
FIG.7

ELECTRICAL CONNECTOR ASSEMBLY

This is a continuation of application Ser. No. 10/262,986, filed Oct. 2, 2002, now abandoned.

FIELD OF THE INVENTION

This invention generally relates to the art of electrical connectors and, particularly, to an electrical connector assembly which includes a plurality of terminals providing a unique termination pattern.

BACKGROUND OF THE INVENTION

Generally, a typical electrical connector includes some form of dielectric housing mounting a plurality of conductive terminals. The housing may include a mating end for interengaging a mating connector or other complementary connecting device, as well as a terminating end at which the terminals are terminated to various electrical transmission components ranging from circuit boards to discrete electrical wires. High density connectors are well known in the electronic industry as well as the automotive industry. In both industries, the ever-increasing miniaturization and high density of the circuits has created design problems in terminal spacing and configuration. An example is in a header connector which uses closely-spaced terminal pins.

For instance, the terminating ends of the terminal pins in some header connectors may be "wire bonded" to a plurality of discrete electrical wires. The wire bonding is carried out by surface connection with the use of ultrasonic energy and the application of pressure. The discrete electrical wires may have a given, sometimes short length and lead from the terminating ends of the terminal pins to contact pads on an adjacent printed circuit board. There are limitations in the length of such wires which creates design problems. In other words, in any given application, the wires may have a maximum length beyond which vibrations will cause the wires to touch each other.

Another problem involves the pattern or array of the terminal pins at the mating end of the connector. Most often, the terminal pins are arranged in rows. In order to achieve a high density pattern, the pins in adjacent rows are offset or staggered relative to each other in directions perpendicular to the rows. However, there are applications wherein offset terminal pins is not desirable. The pins may be required to be in a "square" pattern, i.e., the pins in the adjacent rows are aligned with each other. This square pattern of pins at the mating end of the connector creates problems at the terminating end of the connector where the terminating ends of the terminal pins may be wire bonded to discrete electrical wires.

The present invention is designed to solve these various problems, including the provision of a unique terminal configuration which allows the terminal pins to be disposed in a square pattern while the terminating ends of the pins are in an offset pattern.

SUMMARY OF THE INVENTION

An object, therefore, of the invention is to provide a new and improved electrical connector assembly of the character described.

In the exemplary embodiment of the invention, an electrical connector termination assembly includes a dielectric pin holder. A plurality of elongated terminal pins extend through the pin holder in a pattern of at least two rows of pins, with the pins in the respective rows being aligned transversely of the rows. Each of at least some of the terminal pins define a longitudinal axis and include an arm at a termination end of the pin offset from the longitudinal axis. The arm is bent to define a termination pad extending transversely of the longitudinal axis.

As disclosed herein, one embodiment of a dielectric pin holder includes a plurality of passages within which the terminal pins are press-fit. The pin holder is provided as a generally flat wafer. In another embodiment, the pin holder is a plastic member overmolded about portions of the terminal pins, leaving the termination pads exposed.

According to one aspect of the invention, the arm at the termination end of each pin is bent generally at a right-angle to the longitudinal axis of the respective terminal pin. The termination pad is formed on a side of the arm and includes a generally flat surface in a plane generally perpendicular to the longitudinal axis of the respective terminal pin. The flat surface is wider than the respective terminal pin.

According to another aspect of the invention, the arms at the termination ends of the terminals in one row thereof are offset to one side of the terminals longitudinally of the row. The arms at the termination ends of the terminals in the other row thereof are offset to an opposite side of the terminals longitudinally of the row. The arms at the termination ends of the terminals in each row thereof may be bent toward the other row of terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 5 is an enlarged, somewhat schematic illustration of the discrete electrical wires extending between the termination pads of the terminals and the contact pads of the printed circuit board;

FIG. 6 is a perspective view of a pair of terminals with one terminal being taken from each of a pair of adjacent rows thereof;

FIG. 7 is a perspective view looking at the back-side of FIG. 6; and

DETAILED DESCRIPTION OF THE PREFERRED EMBODIMENT

Figure 1:
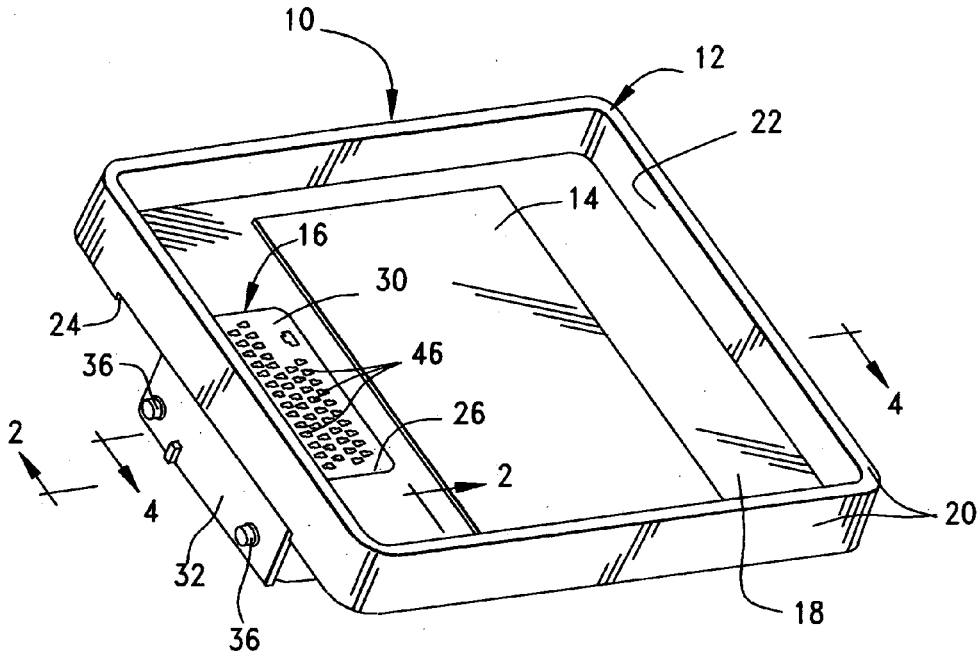
FIG. 1 is an electrical connector assembly incorporating the termination assembly of the invention, with the discrete electrical wires removed to facilitate the illustration and avoid cluttering the depiction.

Referring to the drawings in greater detail, and first to FIGS. 1–4, an electrical connector assembly, generally designated 10, includes a frame, generally designated 12, a printed circuit board 14 disposed within the frame, and a termination assembly which includes a header connector, generally designated 16, which projects from the bottom of the frame.

Frame 12 of connector assembly 10 includes a generally square bottom wall 18 bounded by four upstanding side walls 20 to define a cavity 22 within which printed circuit board 14 is mounted on bottom wall 18. Header connector 16 is mounted within a recessed area 24 at the bottom of frame 12, with the header connector being exposed in cavity 22 through an opening 26 in bottom wall 18.

Figure 2:
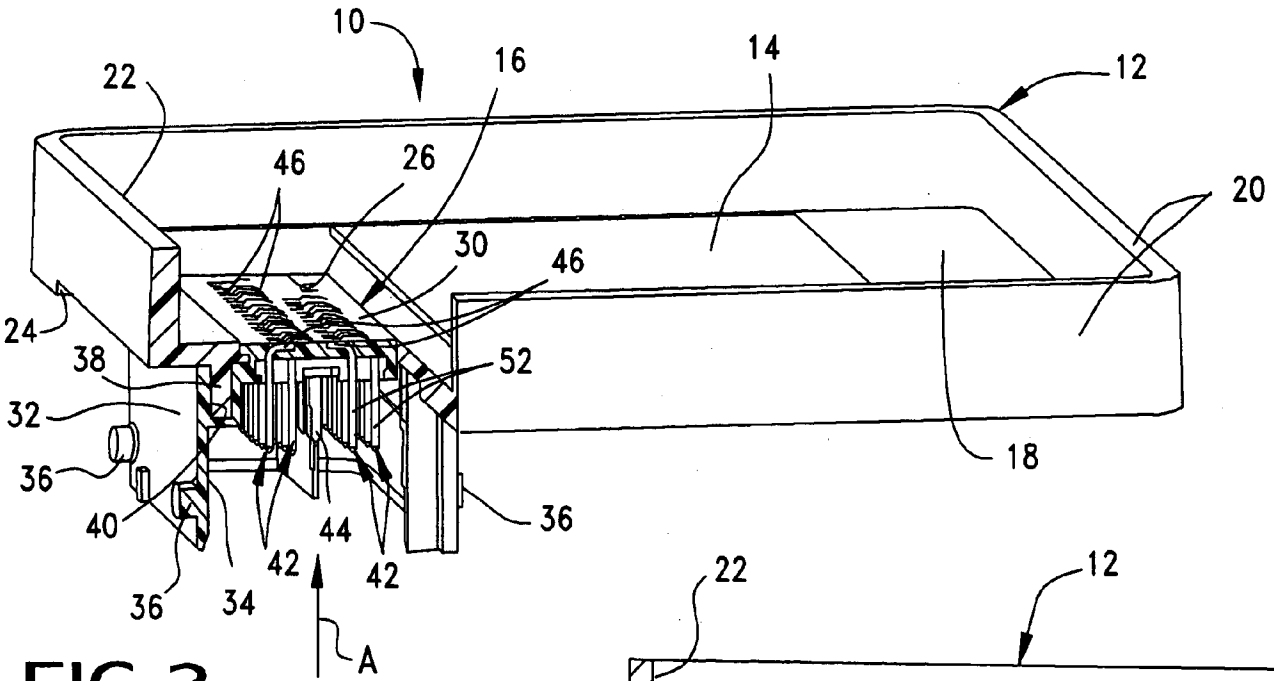
FIG. 2 is a vertical section taken generally along line 2—2 of FIG. 1.
Figure 4:
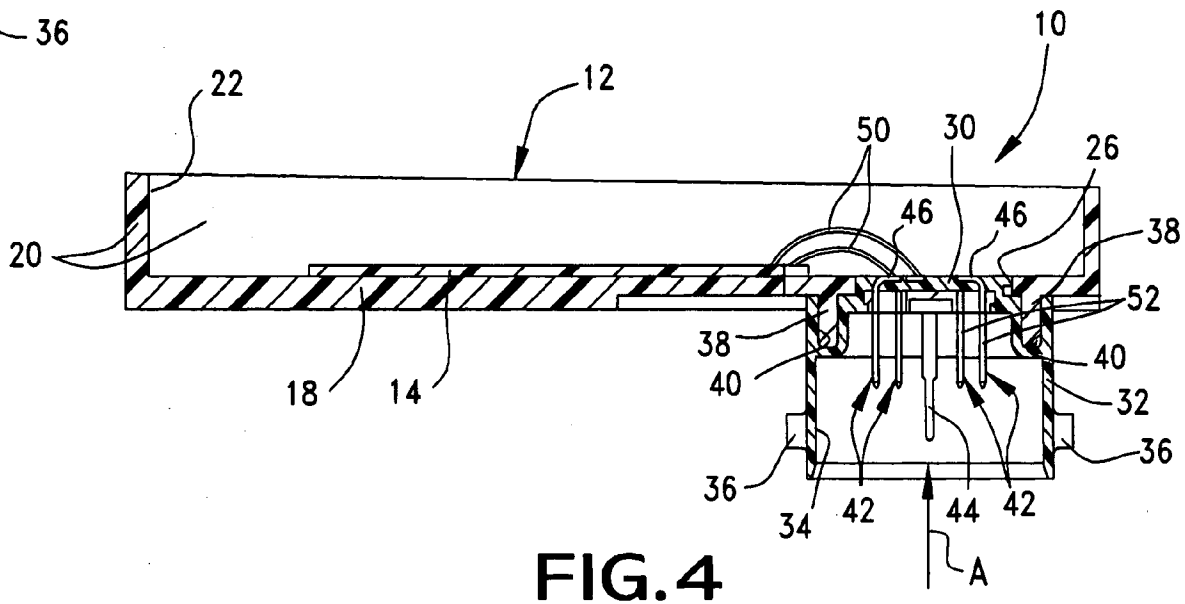
FIG. 4 is a vertical section taken generally along line 4—4 of FIG. 1.

Header connector 16 includes a wafer-like pin holder 30 which substantially fills opening 26 in bottom wall 18 of frame 12. A shroud 32 projects downwardly below the frame from the pin holder. The wafer-like pin holder and the shroud may be molded of dielectric material such as plastic or the like in a one-piece structure. In essence, pin holder 30 defines a terminating end of header connector 16, and shroud 32 defines a mating end of the connector. The shroud is generally hollow to define an interior cavity 34 for receiving a mating connector in the direction of arrows "A" (FIGS. 2 and 4). A pair of latch bosses 36 project outwardly from opposite sides of shroud 32 for engaging appropriate latch means on the mating connector. Bottom wall 18 of frame 12 includes a continuous flange 38 positioned into a groove 40 in the connector assembly as best seen in FIG. 4 to mount the header connector to the frame either by a press-fit or by using appropriate adhesives.

A plurality of terminals, generally designated 42 (FIGS. 2 and 4), are mounted in the wafer-like pin holder 30 of header connector 16. The terminal pins are mounted in two rows on each opposite side of a ground plate 44. The terminal pins are elongated and define longitudinal axes. The terminal pins may be press-fit in terminal-receiving passages in pin holder 30, or the pin holder may be overmolded about portions of the pins.

Figure 3:
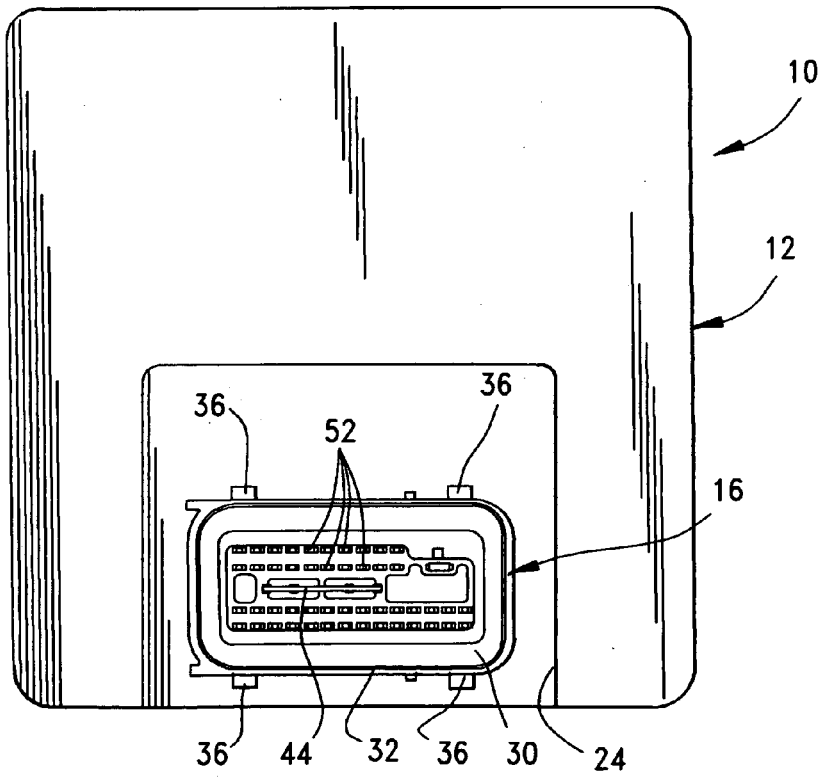
FIG. 3 is a bottom plan view of the assembly of FIG. 1.

It should be noted in FIG. 3 that terminal pins 42 in each of the two rows on opposite sides of ground plate 44 are in a "square" pattern. In other words, the pins in one row are aligned with the pins in the second row in a direction transversely of the rows. However, it should be noted in FIG. 1 that the pins have termination pads 46 exposed at the top of pin holder 30, and the termination pads in each pair of rows are offset or staggered relative to each other. The configurations of the terminal pins for converting the square pattern of pins to the offset pattern of termination pads will be described hereinafter.

Referring to FIG. 5 in conjunction with FIG. 4, printed circuit board 14 is shown with a plurality of contact pads 48 which are arranged in two rows, with the contact pads in each row being offset or staggered relative to each other. The array of termination pads 46 of terminal pins 42 (FIGS. 2 and 4) also are shown. It can be seen that a plurality of discrete electrical wire lengths 50 interconnect termination pads 46 of the terminal pins with contact pads 48 of the printed circuit board. FIG. 4 shows that the electrical wires are at different vertical levels so that they do not touch each other. The electrical wires are "wire bonded" to the termination pads as described in the Background, above. Again, it can be seen that termination pads 46 of the terminal pins are in an offset or staggered array or pattern in each of the two rows thereof, whereas the terminal pins 42, themselves, are mounted in pin holder 30 in a square pattern as shown in FIG. 3.

FIGS. 6 and 7 show the configurations of terminal pins 42 in greater detail. The pins may be stamped and formed of sheet metal material. Each pin includes a pin portion 52 which projects into shroud 32 as seen in FIGS. 2 and 4, for mating with appropriate terminals of the mating connector. Each pin includes a widened retention section 54 which is press-fit into one of the terminal-receiving passages in pin holder 30. The terminal pins are elongated, and pin portions 52 define longitudinal axes 56 of the respective pins. FIGS. 6 and 7 are arranged to depict a terminal pin from each row in one of the pair of rows, and to show that pin portions 52 of the two terminal pins are aligned with each other transversely of the rows.

Figure 8:
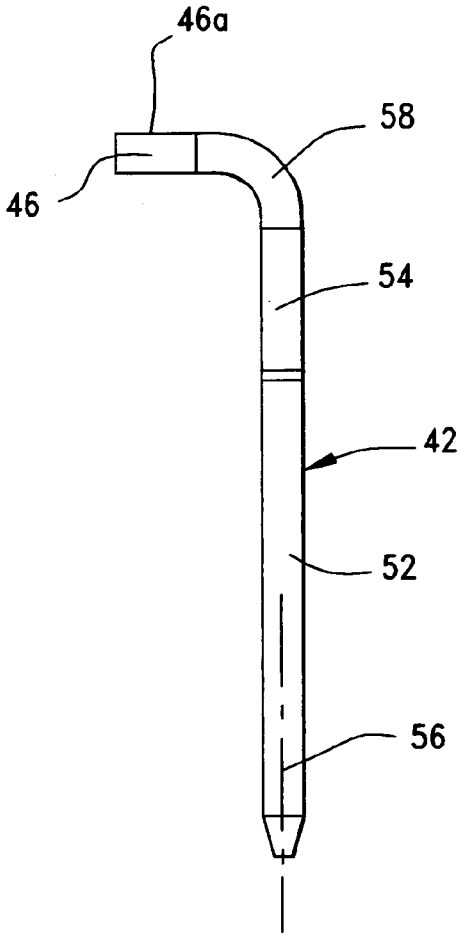
FIGS. 8 and 9 are mutually perpendicular, side elevational views of one of the terminals.
Figure 9:
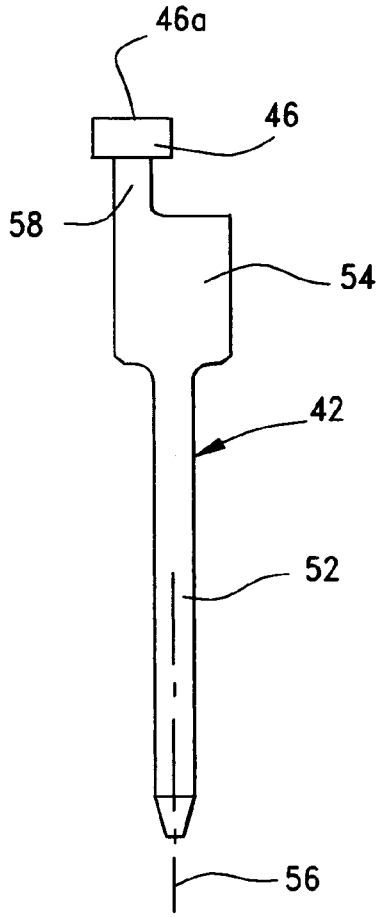

Still referring to FIGS. 6 and 7, each terminal pin 42 includes an arm 58 at a termination end of the pin offset to one side of axis 56 of the respective pin. It can be seen that arm 58 is bent generally at a right-angle to longitudinal axis 56 of the respective terminal pin. The arm is widened at a distal end thereof to form one of the termination pads 46 having a generally flat surface **46*a* at a side of the arm. With the arm bent, flat surface 46*a* lies in a plane generally perpendicular to the longitudinal axis 56 of the respective terminal pin, with the flat surface being wider than arm 58 and, in fact, wider than pin portion 52 of the terminal. FIGS. 8 and 9 show elevational views of the left-hand terminal pin 42 as is viewed in FIG. 6**.

Referring either of FIGS. 6 or 7, it can be seen that arm 58 at the termination end of the terminal pin in one row thereof is offset to one side of the terminal pin longitudinally of the row, and the arm at the termination end of the terminal pin in the other row thereof is offset to an opposite side of the terminal pin longitudinally of the row. In the specific illustration in FIG. 6, arm 58 of the left-hand terminal pin 42 is offset to the left-hand side of the pin (i.e., axis 56), and arm 58 of the right-hand terminal pin 42 is offset to the right of axis 56 of the right-hand terminal pin. This staggered relationship of the arms of transverse pairs of terminal pins repeats lengthwise of the two rows of pins whereupon the staggered array of termination pads 46 as shown in FIG. 5 is effected. In addition, as clearly seen in FIGS. 2 and 4, the arms of terminal pins 42 in the left-hand pair of rows are bent inwardly (i.e., to the right) whereas the arms of the terminal pins in the right-hand pair of rows are bent inwardly at an opposite direction (i.e., to the left). In other words, the arms at the termination ends of the terminal pins in each pair of rows are bent toward the termination ends of the terminal pins in the other pair of rows. This results in a tighter or more closely-spaced array of termination pads 46 for all four rows combined.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector termination assembly, comprising:

a dielectric pin holder; and a plurality of elongated terminal pins extending through the pin holder in a pattern of at least two rows of pins with the pins in the respective rows being aligned transversely of the rows, each of at least some of the terminal pins defining a longitudinal axis and including an arm at a termination end of the pin offset from the longitudinal axis, the arm being bent to define a termination pad extending transversely of the longitudinal axis, the arms of the terminal pins of the at least two rows of pins being offset from respective ones of the pin longitudinal axes such that all of the termination pads of the pins in the respective rows are offset transversely of the rows, the arms at the termination ends of the terminal pins in one row thereof being offset to one side of the terminal pins longitudinally of the row, the arms at the termination ends of the terminal pins in the other row thereof being offset to an opposite side of the terminal pins longitudinally of the row, and the arms at the termination ends of the terminal pins in each row thereof being bent toward the other row of terminal pins.

2. The electrical connector termination assembly of claim 1 wherein said dielectric pin holder includes a plurality of passages within which the terminal pins are press-fit.

3. The electrical connector termination assembly of claim 2 wherein said dielectric pin holder comprises a generally flat wafer.

4. The electrical connector termination assembly of claim 1 wherein said dielectric pin holder is a plastic member overmolded about portions of the terminal pins leaving said termination pads exposed.

5. The electrical connector termination assembly of claim 1 wherein each said terminal pad is wider than the respective terminal pin.

6. The electrical connector termination assembly of claim 1 wherein said arm is bent generally at a right-angle to the longitudinal axis of the respective terminal pin.

7. The electrical connector termination assembly of claim 6 wherein said termination pad is formed on a side of the arm of the respective terminal pin.

8. The electrical connector termination assembly of claim 6 wherein said termination pad comprises a generally flat surface in a plane generally perpendicular to the longitudinal axis of the respective terminal pin.

9. The electrical connector termination assembly of claim 8 wherein said flat surface is wider than the respective terminal pin.

10. An electrical connector termination assembly, comprising:

a dielectric pin holder; and a plurality of elongated terminal pins extending through the pin holder in a pattern of at least two rows of pins with the pins in the respective rows being aligned transversely of the rows, each of at least some of the terminal pins defining a longitudinal axis and including an arm at a termination end of the pin offset from the longitudinal axis, the arm being bent generally at a right-angle to the longitudinal axis of the respective terminal pin to define a termination pad on a side of the arm with the pad forming a generally flat surface in a plane generally perpendicular to said longitudinal axis, all of the arms at the termination ends of the terminal pins in one row thereof being offset to one side of the terminal pins longitudinally of the row, all of the arms at the termination ends of the terminal pins in the other row thereof being offset to an opposite side of the terminal pins longitudinally of the row and the arms at the termination ends of the terminal pins in each row thereof being bent toward the other row of terminal pins.

11. The electrical connector termination assembly of claim 10 wherein said flat surface is wider than the respective terminal pin.

12. The electrical connector termination assembly of claim 10 wherein said dielectric pin holder includes a plurality of passages within which the terminal pins are press-fit.

13. The electrical connector termination assembly of claim 10 wherein said dielectric pin holder comprises a generally flat wafer.

14. The electrical connector termination assembly of claim 10 wherein said dielectric pin holder is a plastic member overmolded about portions of the terminal pins leaving said termination pads exposed.

15. An electrical connector termination assembly, comprising:

a dielectric pin holder; and a plurality of elongated terminal pins extending through the pin holder in a pattern of at least two rows of pins with the pins in the respective rows being aligned transversely of the rows, each of at least some of the terminal pins defining a longitudinal axis and including an arm at a termination end of the pin offset from the longitudinal axis, the arm being bent to define a termination pad extending transversely of the longitudinal axis, the arms of the terminal pins of the at least two rows of pins being offset from respective ones of the pin longitudinal axes such that all of the termination pads of the pins in the respective rows are offset transversely of the rows, the arms at the termination ends of the terminal pins in one row thereof being offset to one side of the terminal pins longitudinally of the row, the arms at the termination ends of the terminal pins in the other row thereof being offset to an opposite side of the terminal pins longitudinally of the row, and the arms at the termination ends of the terminal pins in both rows thereof being bent in the same direction transversely of the rows.

16. The electrical connector termination assembly of claim 15 wherein the arms of the terminal pins are bent generally at right-angles to the longitudinal axes of the respective terminal pins.

17. The electrical connector termination assembly of claim 16 wherein said termination pads are formed on sides of the respective arms of the respective terminal pins.

18. The electrical connector termination assembly of claim 16 wherein said termination pads comprise generally flat surfaces in planes generally perpendicular to the respective longitudinal axes of the respective terminal pins.

19. The electrical connector termination assembly of claim 18 wherein said flat surfaces are wider than the respective terminal pins.

* * * * *